United States Patent [19]

Evans

[11] Patent Number: 5,002,257

[45] Date of Patent: Mar. 26, 1991

[54] BRICK HAMMER WITH NAIL PULLER

[76] Inventor: John Evans, Rte. 1, Fort Cobb, Okla. 73038

[21] Appl. No.: 513,583

[22] Filed: Apr. 23, 1990

[51] Int. Cl.[5] ..... B66F 15/00

[52] U.S. Cl. ..... 254/26 R

[58] Field of Search ..... 254/25-27, 254/18, 19, 21, 23

[56] References Cited

U.S. PATENT DOCUMENTS

| | | | |
|---|---|---|---|
| 170,972 | 12/1875 | Thayer | 254/26 R |
| 668,046 | 2/1901 | Innes . | |
| 872,886 | 12/1907 | Bates . | |
| 994,775 | 6/1911 | Nelson . | |
| 1,114,910 | 10/1914 | Reed . | |
| 1,215,180 | 2/1917 | Morrow | 254/25 |
| 1,499,302 | 10/1923 | Hobson . | |
| 1,660,237 | 4/1927 | Small . | |
| 1,721,270 | 10/1927 | Doebler . | |
| 4,482,132 | 11/1984 | Lamansky . | |
| 4,561,635 | 12/1985 | Lamansky . | |

FOREIGN PATENT DOCUMENTS

| | | | |
|---|---|---|---|
| 47987 | 7/1909 | Switzerland | 254/25 |
| 6554 | of 1891 | United Kingdom | 254/26 R |

*Primary Examiner*—Robert C. Watson

*Attorney, Agent, or Firm*—Young & Thompson

[57] ABSTRACT

A brick hammer having a handle, a head and a tail and an upper surface extending between the head and the tail on the side of the hammer opposite the handle, has a nail puller fixedly secured to that upper surface and overlying at least most of the width of the upper surface. The nail puller has a pair of claws separated by a V-shaped gap that overlies at least a portion of the width of that upper surface. The claws extend beyond that upper surface and terminate in free ends spaced from the upper surface. The claws have under surfaces on each claw that diverge downwardly in a direction away from the other claw toward the upper surface. The gap overlies at least most of the width of that upper surface. The free ends of the claws are spaced from that upper surface a distance which is a minor fraction of the width of the upper surface and have under surfaces which are inclined downwardly in a direction from the free ends toward the upper surface. There is a recess in the hammer in which the handle is disposed. The tail terminates in a free cutting edge, the nail puller being disposed between the recess and the cutting edge and more closely adjacent the recess than the cutting edge.

4 Claims, 1 Drawing Sheet

BRICK HAMMER WITH NAIL PULLER

FIELD OF THE INVENTION

The present invention relates to a brick hammer with a nail puller.

BACKGROUND OF THE INVENTION

Brick hammers are especially constructed for the performing various operations required during the laying of bricks. Thus, they are conventionally provided with an enlarged and hence relatively heavy head that terminates forwardly in a relatively flat face adapted to be struck against a brick without damaging the brick. Rearwardly from the head, the hammer narrows to a tail which terminates rearwardly in a cutting edge which can be wider than the head and which is used to score a brick, for the purpose of locating and directing a subsequent fracture of the brick.

In use, the bricklayer may simply use his hammer to align and properly position bricks that have been laid in wet mortar.

Also, a very important function of a brick hammer is to break bricks of standard size so as to form bricks of smaller size, ordinarily half bricks. To do this, the bricklayer first strikes the brick at the intended fracture point, with the cutting edge on the tail of the hammer so as to initiate fracture of the brick; and then, turning the hammer 180°, he strikes the brick with the face on the head of the hammer to one side of the line formed by the cutting edge, so as to break the brick at that line.

The bricks thus broken can be used, at, say, the end of a row of bricks, or in what is known in the art as a "clinker job", in which broken bricks are set at random in a wall achieve a decorative effect, with their broken surfaces protruding somewhat from the wall, so as to relieve what would otherwise be the monotony of a plain brick wall.

It frequently happens that the bricks are set in or closely adjacent wooden framework. This wooden framework may be pre-existing or may be part of the same construction as the bricks that are being laid. In either event, the wooden framing may have protuberant nails that would interfere with the bricks being laid; and so bricklayers have need of a nail pulling tool.

THE KNOWN PRIOR ART

It is already known to provide a brick hammer with a nail pulling attachment, as in Nelson U.S. Pat. No. 994,775. In this patent, a brick hammer is formed on its upper surface, apparently by casting, with an enlargement extending lengthwise of the hammer head. This enlargement is then drilled in such a way as to provide a slot for receiving the shank of a nail with the nail head in the drilled bore, after which the nail can be pulled by manipulation of the brick hammer. However, such a brick hammer is costly to produce and the leverage for pulling a nail is not favorable.

A hammer is known from Bates U.S. Pat. No. 872,886 which is not a brick hammer, but rather is a claw hammer with an extra claw directed transversely of the head. Again, however, such a hammer is costly to produce and does not give favorable leverage for pulling nails.

Other hammers with unusually shaped and/or positioned nail pulling devices are disclosed in U.S. Pat. Nos. 668,046, 1,114,910, 1,499,302, 1,660,237, 1,721,270, 4,482,132 and 4,561,635.

OBJECTS OF THE INVENTION

It is accordingly an object of the present invention to provide a brick hammer with a nail puller, which gives favorable leverage for pulling nails.

Another object of the present invention is the provision of a brick hammer with a nail puller, in which the nail puller does not protrude to such an extent as to be inconvenient or even dangerous.

Still another object of the present invention is the provision of a brick hammer with a nail puller, in which the nail puller is so positioned as to be firmly secured to the hammer, thereby to resist forces tending to dislodge it from the hammer.

It is also an object of the present invention to provide a brick hammer with a nail puller that firmly grasps the head of the nail when pulling the same.

Yet another object of the present invention is the provision of a brick hammer with a nail puller, in which the nail puller can be provided by simple addition to existing types of brick hammers without otherwise altering the contours of the brick hammer.

Finally, it is an object of the present invention to provide a brick hammer with a nail puller, which will be relatively simple and inexpensive to manufacture, and rugged and durable in use.

BRIEF SUMMARY OF THE INVENTION

The above objects are achieved, by providing a brick hammer with a nail puller, according to the present invention, in which there is secured to the upper surface of a forward portion of the tail of the hammer, and transversely to the length of the hammer in a head-to-tail direction, a nail puller in the form of two claws having a V-shaped gap between them, for reception of the head of a nail between the claws and the upper surface of the hammer, a substantial portion of the claws overlying the upper surface of the hammer and a relatively small portion of the claws, preferably for more than a minor proportion of the length of the claws, protruding sideways beyond the hammer. This sideways protrusion of the free ends of the claws permits the claws more readily to engage a nail to be pulled, whose shank is then slid toward the narrow end of the V-shaped gap between the claws to grasp the shank firmly between the claws, after which the nail can be easily pulled by swinging the hammer handle in an appropriate direction about an axis extending generally between the head and the cutting edge on the tail of the hammer. At that time, the nail head is firmly grasped, not only between the claws themselves, but also between the claws and the upper surface of the hammer. At the same time, this movement of the nail toward the apex of the V-shaped gap between the claws has positioned the nail head so that it overlies the upper surface of the hammer and thus is only a very short distance from the longitudinal edge of the hammer which is opposite that longitudinal edge beyond which the free ends of the claws protrude. This gives very good leverage for pulling the nail; and if the nail is embedded, say, in concrete, then this very high leverage is quite important for exerting the initially very high leverage necessary to break the nail loose from the concrete.

Because the nail puller overlies and is secured to the upper surface of the hammer, it can be added to existing hammers simply by welding. Thus, the hammer itself does not need to be deformed in anyway and so the hammer is not weakened. At the same time, the construction of a device according to the present invention is made quite simple and inexpensive, because existing hammer heads need undergo only a very simple welding operation, in order to produce brick hammers with nail pullers according to the present invention. Thus, the casting dies in which conventional brick hammers are cast need not be changed in any way, and no special tools are required for the production of nail pullers according to the invention. They can be formed by simple machining operations or by casting, and can be easily applied to the hammers by welding, so that the cost of a brick hammer with a nail puller according to the present invention is very little more than that of a brick hammer without.

BRIEF DESCRIPTION OF THE DRAWING

Other objects, features and advantages of the present invention will become apparent from a consideration of the following description, taken in connection with the accompanying drawing in which.

DETAILED DESCRIPTION OF THE INVENTION

Figure 1:
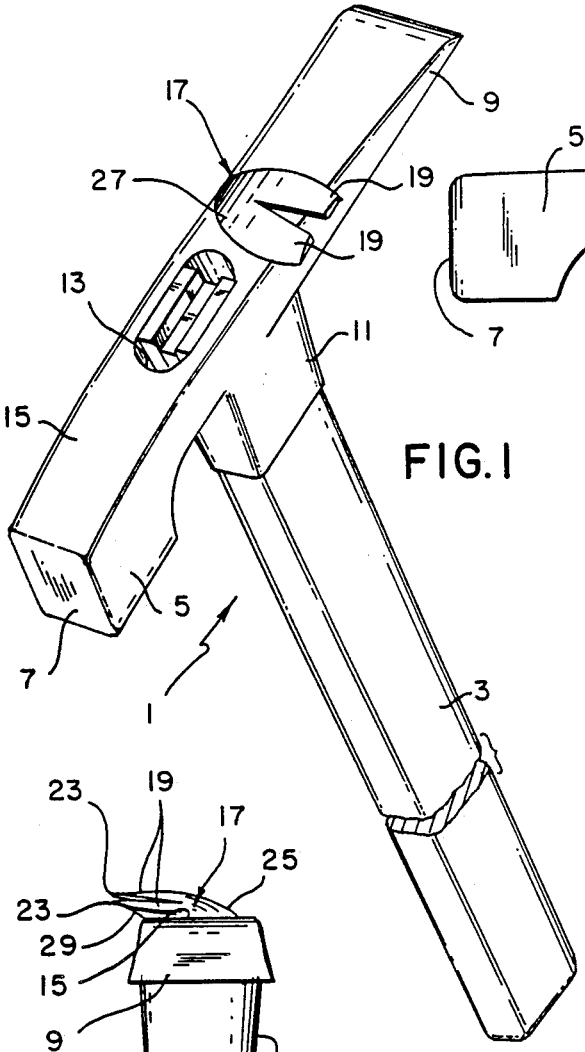
FIG. 1 is a perspective view of a brick hammer with nail puller, to the present invention.

Referring now to the drawing in greater detail, and first to FIG. 1 thereof, there is shown a brick hammer with nail puller according to the present invention, indicated generally at 1, comprising a conventional wooden handle 3. The hammer portion itself comprises an enlarged and hence relatively heavy head 5 which terminates forwardly in a face 7 which, as is usual, is substantially flat with rounded edges, the better to strike bricks broadside without marking the surface of the brick.

The hammer tapers rearwardly from head 5 to a reduced portion which becomes a tail 9, that terminates rearwardly in a cutting edge which is ordinarily somewhat wider than face 7, for the purpose of scoring or initiating the fracture of bricks prior to breaking them. Intermediate head 5 and tail 9 is a shank or cheek 11, which is hollow and thus provides a recess 13 extending entirely through the hammer at about the midpoint thereof, for the reception of a split end of handle 3. As is conventional, the split in the end of handle 3 is wedged so as to force the sides of the end of handle 3 against the sides of recess 13, thereby to hold the hammer securely on the handle.

Figure 3:
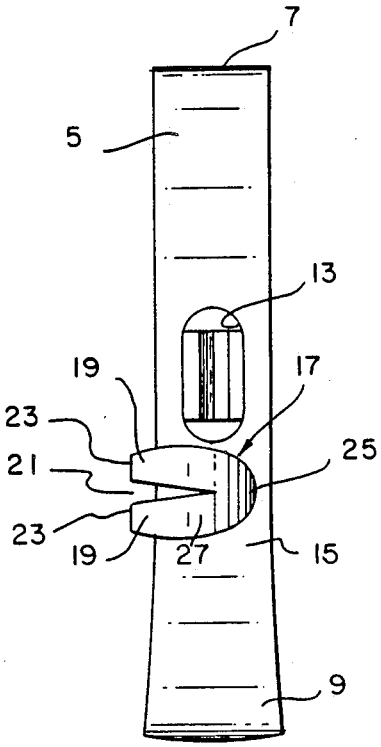
FIG. 3 is top plan view thereof.

The structure of the brick hammer described thus far is entirely conventional. What is new is as follows:

On the upper surface 15 of the hammer is secured as by welding a nail puller 17, comprising a pair of claws 19 separated by a gap 21 that is generally V-shaped and has its apex preferably at least halfway toward that side of the hammer which is the right side shown in FIG. 3 of the drawing.

The claws 19 terminate in free ends 23 that are spaced from what is shown as the left side of the hammer in FIG. 3, so that the claws 19 have the major portion of their length overlying the hammer and a minor portion extending to one side beyond the hammer. Preferably, the nail puller 17 occupies the entire width of the hammer, as seen in FIG. 3. Also, as seen in FIG. 3, it is preferred that the overhanging portion of the claws 19 be about one quarter of the entire length of nail puller 17.

Figure 4:
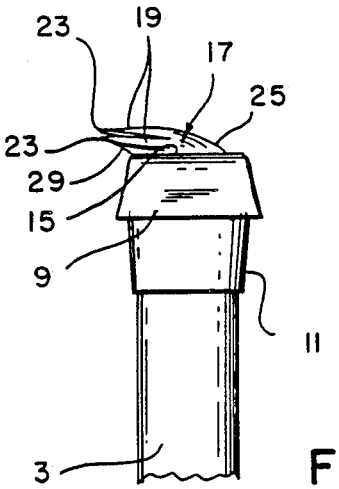
FIG. 4 a fragmentary end elevational view thereof from the tail of the hammer, that is, from the right of FIG. 2.

The claws 19 thus converge toward a base 25; and as is best seen in FIG. 4 of the drawing, the upper surfaces 27 of the claws 19 have their highest point at ends 23 and are smoothly rounded toward base 25, which in turn forms a smoothly rounded continuation of the side of the hammer.

Figure 2:
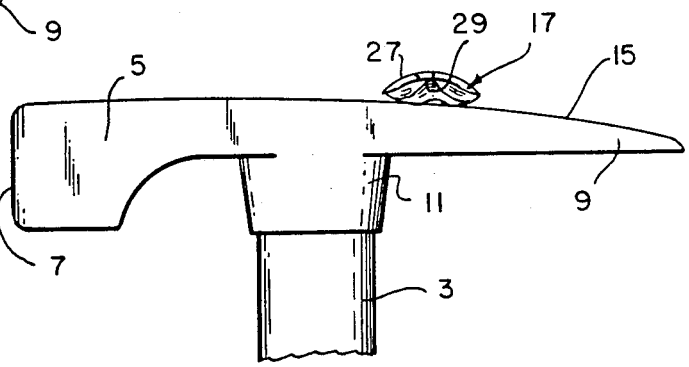
FIG. 2 is a fragmentary side elevational view thereof.

As is perhaps best seen in FIG. 2, the upper surfaces 27 of the claws 19 form a smoothly rounded or dome-shaped surface when viewed from the side of the hammer, this surface being interrupted only by the V-shaped gap 21.

As is best seen by comparison of FIGS. 2 and 4, the claws 19 have under surfaces 29 that are inclined, as seen in FIG. 2, downwardly away from each other, and, as seen in FIG. 4, are inclined from free ends 23 of the claws 19 downwardly toward upper surface 15 of the hammer.

As a result of the construction described, it will be understood that, when the brick mason encounters a nail, he need only invert the hammer and insert the shank of the nail in the gap 21. The V shape of the gap 21 will direct the shank of the nail centrally toward a position in which the shank is gripped between the edges of gap 21, which lie on upper surfaces 27 of nail puller 17. The shank will thus become centered within nail puller 17, at a location that overlies upper surface 15.

The orientation of the under surfaces 29 of the nail puller 17 contributes to the firm gripping of the head of the nail. Specifically, these surfaces, inclined as they are downwardly away from each other as seen in FIG. 2 and downwardly toward upper surface 15 as seen in FIG. 4, form with upper surface 15 in effect a trilateral pocket such that when the nail shank enters gap 21, the nail head is progressively forced down against upper surface 15. With the nail head thus clamped against upper surface 15 and the nail shank gripped between the edges of claws 19 that bound gap 21, there is no opportunity for the nail thereafter to move relative to the hammer.

In this position, the nail shank will be gripped between claws 19 and the nail head will be clamped against upper surface 15, with the axis of the nail disposed between the sides of the hammer as seen in FIG. 3, that is, with the nail head overlying upper surface 15 as seen in FIG. 3.

This positions the nail so close to the right side of the hammer as shown in FIG. 3, that the brick mason need only swing the handle 3 in the nail-pulling direction, whereupon the edge of the hammer which is the upper right edge shown in FIG. 4, becomes a fulcrum about which the hammer swings. This fulcrum is located so close to the nail head, that the leverage exerted on the nail is very great and the pulling force is correspondingly increased. The nail-pulling operation can thus be started, even if the nail is for example embedded in concrete: the force applied in this manner is so great that it can break the nail loose even from concrete. Thereafter, once the nail has begun to be pulled, another end of the hammer, either the sharpened end of the tail or even the head 5 itself, can be used as the fulcrum about which to complete the nail-pulling operation. Naturally, the pulling force is not as great when a fulcrum farther from the nail is used, but for the end of the nail-pulling operation, this is often acceptable.

Even if another fulcrum is subsequently used, however, the nail will not escape from the gap 21, because, as previously pointed out, the nail head is clamped between the under surfaces 29 of the nail puller and the upper surface 15 of the hammer. The wedging action of the nail in this trilateral pocket, is sufficiently strong that the nail will not escape even when the direction of the application of a nail-pulling force is at right angles to the initial direction described above.

From a consideration of the foregoing disclosure, therefore, it will be evident that all of the initially recited objects of the present invention have been achieved.

Although the present invention has been described and illustrated in connection with a preferred embodiment, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a brick hammer having a handle, a head and a tail and an upper surface extending between the head and the tail on the side of the hammer opposite the handle; the improvement comprising a nail puller fixedly secured to said upper surface and overlying at least most of the width of said upper surface, said nail puller having a pair of claws separated by a V-shaped gap that overlies at least a portion of the width of said upper surface, said claws extending beyond said upper surface and terminating in free ends spaced from said upper surface, said claws having under surfaces on each claw that diverge downwardly in a direction away from the other claw toward said upper surface, said under surfaces of said claws being inclined downwardly in the direction of the width of said upper surface from said free ends toward said upper surface, whereby said under surfaces of said claws and said upper surface of the hammer form a three-sided pocket such that when a nail head is inserted in said pocket the nail head is progressively forced against said upper surface.

2. A brick hammer as claimed in claim 1, said V-shaped gap having a closed apex that overlies a point intermediate the width of said upper surface.

3. A brick hammer as claimed in claim 1, said free ends being spaced from said upper surface a distance which is a minor fraction of the width of said upper surface.

4. A brick hammer as claimed in claim 5, said V-shaped gap having a closed apex that overlies a point intermediate the width of said upper surface.

* * * * *